United States Patent [19]

Romey

[11] 4,183,802

[45] Jan. 15, 1980

[54] PROCESS FOR THE PRODUCTION OF COKE FROM PITCH

[75] Inventor: Ingo Romey, Hünxe, Fed. Rep. of Germany

[73] Assignee: Bergwerksverband GmbH, Essen, Fed. Rep. of Germany

[21] Appl. No.: 953,168

[22] Filed: Oct. 20, 1978

Related U.S. Application Data

[63] Continuation of Ser. No. 783,339, Mar. 31, 1977, abandoned.

[30] Foreign Application Priority Data

Apr. 3, 1976 [DE] Fed. Rep. of Germany ..... 2614490

[51] Int. Cl.[2] ..... C10G 17/00

[52] U.S. Cl. ..... 208/88; 208/106

[58] Field of Search ..... 208/106, 131, 88

[56] References Cited

U.S. PATENT DOCUMENTS 1,283,229 10/1918 Lee ..... 208/131

FOREIGN PATENT DOCUMENTS 2434295 1/1976 Fed. Rep. of Germany ..... 208/131

1190142 4/1970 United Kingdom ..... 208/131

*Primary Examiner*—O. R. Vertiz

*Assistant Examiner*—Wayne A. Langel

*Attorney, Agent, or Firm*—Michael J. Striker

[57] ABSTRACT

A process is provided for the production of an aciculate textured coke from pitch comprising the steps of filtering at least two different bituminous coal tar pitches having differing softening points at an elevated temperature to form a mixture of the filtrate having a viscosity of 50–200 centipoise at 250°–260° C. and producing an aciculate textured coke by coking said mixture.

9 Claims, No Drawings

PROCESS FOR THE PRODUCTION OF COKE FROM PITCH

This is a continuation, of application Ser. No. 783,339, filed Mar. 31, 1977, now abandoned.

BACKGROUND OF THE INVENTION

The invention relates to a process for the production of a coke from pitch, the coke having an aciculate texture, in which the coal-tar pitch is filtered at an elevated temperature and the filtrate is coked.

It has been proposed that a coke having an aciculate or needle-shaped texture be produced. Due to its specific properties and particularly due to small thermal volume expansion coefficient and a high degree of anisotropy, coke with an aciculate texture is suitable for the production of high quality graphite electrodes. Such an aciculate textured coke is obtained by means of the coking of a residue fraction which accumulates with thermal or catalytic cracking of crude oil fractions or which is produced from gas oil fractions or similar products of crude oil refining. A process for the production of coke from coal for pitch has similarly been proposed; such a process is especially interesting on account of the ready availability of the pitch with respect to both quantity and constant quality.

Certain pitches formed from coal tars are suitable starting materials for the production of an aciculate textured coke from pitch. (German Pat. No. 1,935,467, Offenlegungsschrift 2,025,071 and Auslegenschrift 116 504) Further suitable starting material including coal tar pitch freed of soot-like material (German Auslegenschriften 1,189,517 and 1,257,738). The soot portion of the coal-tar pitch should amount to less than 1%, preferably less than 0.3% of the weight of the pitch. For the separation of the sooty material, whose proportion is fixed like the quinoline-insoluble portions, and which detracts from the aciculate texture, separators, centrifuges or filters are used and, prior to such a separation step, the pitch is dissolved in a solvent such as absorption oil or anthracene oil. The separation of the quinoline-insoluble components can be done by means of filtration. (Auslegenschrift 2,064,695 and Offenlegungsschrift 2,159,862) The separation proceeds particularly smoothly if a certain low-boiling, aromatic compound, such as coal-tar oil, is added in large amounts to the pitch.

The so-purified pitch is coked with the aid of a special multistage low temperature carbonization process or by means of delayed coking in a delayed-coker.

The utility of the process will naturally be determined not only by the quality of the resulting coke from pitch, but also by the expenditure necessary for performing the coking. Especially suitable and advantageous are processes which make possible a (1) simple separation and/or purification of the starting material, (2) a high yield of coke, and (3) production of a high quality coke in conventional coking ovens.

The yield of coke from starting materials obtained by distillation is, however, relatively small in coking under normal conditions. Larger quantities of coke will be obtained only by means of delayed coking under elevated pressure. Even bituminous coal-tar pitch, whose quinoline-insoluble components would separate by sedimentation, centrifugation, or filtration after addition of a solvent or a diluent, gives a poor yield of coke. This disadvantage can be avoided only with the employment of an additional process step for removing the solvent or the diluent, such as the step of distilling off the solvent.

SUMMARY OF THE INVENTION

It is a primary object of the invention to produe an improved aciculate-textured coke from pitch or tar in which the coke has a particularly small thermal volume expansion coefficient.

It is another object of the invention to reduce the number of steps required for the production of a high quality coke from pitch.

It is still another object of the invention to improve proposed processes for the separation by means of filtration of elevated temperature of the quinoline-insoluble mineral and soot-like contaminants from a coal-tar pitch, and in particular, to increase the selectivity and the speed of the separating operation.

DETAILED DESCRIPTION OF A PREFERRED EMBODIMENT

The invention process involves a mixture of at least two filtered coal-tar pitches having different softening points (measured according to Kraemer-Sarnow German Industrial Standard DIN 52,025), the mixture having a viscosity of 50–200 centipoise at 250°–260° C. and then coking such mixture.

It is surprising that an aciculate textured coke can be obtained by coking mixtures of two or more coal-tar pitches having different softening points, with its most important properties—such as the thermal volume expansion coefficient and the anisotropic grade—being better than the properties of cokes produced from a single pitch.

The quality of the so-produced coke from pitch is only insignificantly influenced by the employed process of coking. Therefore the well-known low temperature carbonization and coking processes can be used, possibly with a subsequent calcination of the semicoke produced in a first stage, for the production of an aciculate textured coke from pitch. For example, the coking can be done in a retort or in a coking reactor, according to the processes of the delayed coking. This far-reaching insensitivity of the quality of the coke towards variation in processes of coking has the consequence that even technically unavoidably temperature and pressure fluctuations during the coking do not impair the quality of the coke; therefore, a coke of uniform quality continually accumulates.

In order that the desired improved properties of the aciculate coke will be obtained with certainty, the softening points of the various coal-tar pitches should at least differ from each other by more than 20° K. (kelvin). Recommended for the performance of the process is the use of a mixture provided with a particularly advantageous viscosity of 50–200 centipoise, preferably 50–100 centipoise, at a temperature range of 250°–260° C. Advantageously, the mixture includes relatively low temperature softened pitch with a softening point of below 80° C., preferably 60°–80° C. This mixture also includes a high temperature softened pitch with a softening point of greater than 100° C., preferably within the range of 120° and 180° C.

Each individual component pitch should be present in the pitch mixture in a quantity at least ten percent by weight of the whole, and the combined mixture should have a softening point preferably between 70° and 120° C.

The coal tar pitches can be mixed together before or after the filtration. The filtration of the combined pitch mixture however has the advantage that in particular the rate of filtration of the inventive mixture of pitches and also the selectivity is improved in contrast with the filtration of the individual components. The filtration can take place at elevated temperature without prior additions of solvents, and indeed advantageously at a temperature of 100°-200° C. above the respective softening points of the pitch or mixture of pitches.

Particularly suitable for this hot filtration are vacuum and pressure filters with metal strainers whose aperture sizes amount to about 80 up to about 120 microns. Particularly appropriate as a filter are pressure filters, such as filter candles, which make possible both a pressure of up to about 10 bar and filtrate outputs of from 150 to 400 kg of pitch filtrate per square meter per hour. It is appropriate that the filtration of the coal-tar pitch be performed in the presence of a filter aid, such as Kieselgur in quantities up to 5% of the total weight of the mixture. The filtrate contains, on an average, less than 0.3% of quinoline-insoluble components and less than 0.1% of mineral material.

Direct measurements are well suited for the characterization of a coke; for instance, direct measurement is well suited for the determination of the thermal volume expansion coefficient in the range of 20°-200° C. in chunks cut from large pieces of coke and heated for 6 hours at 1300° C. According to this method, the following coefficients are determined for known kinds of coke:

so-called fluid-coke—14-16$\times 10^{-6}$/°K.

commercial bituminous coal-tar pitch coke—1-2-14$\times 10^{-6}$/°K.

commercial petroleum coke—6-10$\times 10^{-6}$/°K.

commercial aciculate coke—4-6$\times 10^{-6}$/°K.

the inventively produced aciculate coal below 4, preferably—3$\times 10^{-6}$/°K.

With a rising softening point of the mixture, the coke residue increases as does the yield of coke. Therefore, it is preferred to coke, as much as possible; pitch having a high softening point. If, however, the pitch mixture has a viscosity over 200 centipoise at a temperature range of 250°-260° C., then, only aciculate coke with a thermal volume expansion coefficient of about 4 to 6$\times 10^{-6}$/°K. is obtained, probably on account of the poor intermixing of the components and a certain hindering of the interaction between the components. Since the thermal volume expansion coefficient correlates quite well with the optically recognizable texture and with the anisotropic grade of coke—the texture is aciculate and the greater the anisotropic grade, the smaller the thermal volume expansion coefficient—the magnitude of the coefficient can be used as a useful measurement for the quality of cokes and their suitability for the production of high quality graphite bodies. Extruded graphite bodies made from the inventively produced coke from pitch, have, in addition to the low volume expansion coefficient, a very low linear thermal expansion coefficient in the direction of extrusion, namely a coefficient which is less than 0.6$\times 10^{-6}$/°K., and similarly have a very small linear thermal expansion coefficient in a radial direction less than 1.8$\times 10^{-6}$/°K.

EXAMPLE 1

A pitch A with a lower softening point was mixed in such a proportion with a pitch B having a higher softening point that the resultant mixture had a softening point lying between about 70° and 120° C. The mixture was then heated to a temperature of 250°-260° C. and, after mixing with 0.5% by weight of Kieselgur, the mixture was filtered in a pressure filter under a pressure of from 2 to 8 bar. The average filtering output amounted to about 250 kg/m$^2$/h and the filtrate contained 0.1 to 0.3% of quinoline-insoluble constituents. The mixture had the following composition:

| | Pitch A | | Pitch B | | Filtrate Mixture |
|---|---|---|---|---|---|
| No. | Portion | Softening Point | Portion | Softening Point | Softening Point |
| 1 | 90% | 67° C. | 10% | 150° C. | 75 |
| 2 | 70% | 74° C. | 30% | 140° C. | 95 |
| 3 | 60% | 72° C. | 40% | 150° C. | 95 |
| 4 | 80% | 69° C. | 20% | 150° C. | 85 |
| 5 | 85% | 65° C. | 15% | 160° C. | 80 |
| 6 | 55% | 80° C. | 45% | 120° C. | 108 |

The filtrates were then coked with two different heating rates under inert or reducing conditions without pressure:

| I | | II | |
|---|---|---|---|
| 20°-300° C. | 2 hrs. | 20°-500° C. | ca. 100 hrs. |
| 300°-450° C. | 6 hrs. | 500°-600° C. | 20 hrs. |
| 450°-500° C. | 5 hrs. | -900° C. | ca. 2 hrs. |
| -900° C. | ca. 2 hrs. | | |

| | Yield | | |
|---|---|---|---|
| | Carbon residue | | Thermal volume expansion |
| No. | I | II | coefficient |
| 1 | 68% | 65% | 3.8 . 10$^{-6}$/° K. |
| 2 | 67% | 65% | 3.3 . 10$^{-6}$/° K. |
| 3 | 69% | 67% | 3.7 . 10$^{-6}$/° K. |
| 4 | 70% | 62% | 1.5 . 10$^{-6}$/° K. |
| 5 | 74% | 68% | 1.9 . 10$^{-6}$/° K. |
| 6 | — | 69% | 3.8 . 10$^{-6}$/° K. |

EXAMPLE 2

Under the previously mentioned conditions, three bituminous coal tar pitches with respective softening points of 65°, 80° and 130° C. were filtered and the filtrate was mixed respectively in proportions of 30:40:30. The mixture had a softening point of 91° C. The mixture coked; a coke residue, i.e., the yield of coke, of 63% by weight was obtained. The thermal volume expansion coefficient amounted to 2.8$\times 10^{-6}$/°K.

It will be understood that each of the elements described above, or two or more together, may also find a useful application in other types of processes differing from the types described above.

While the invention has been illustrated and described as embodied in a process for the production of coke from pitch, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A process for producing needle-shaped coal pitch coke, comprising the steps of heating a coal-tar pitch having a softening point within the range of 60°–80° C. and at least one other coal-tar pitch having a softening point within the range of 100°–180° C.; heating the pitches to an elevated temperature; filtering the pitches to remove solid impurities therefrom; mixing the pitches so as to form a pitch mixture having a softening point within the range of 70°–120° C. and containing both said one pitch and said other pitch in amounts which are respectively at least ten percent by weight of the total mixture; and coking the filtered mixture to produce the desired needle-shaped coal pitch coke.

2. The process of claim 1, wherein three pitches are mixed and the mixture includes each pitch in an amount of at least ten percent by weight of the mixture.

3. The process of claim 1, said step of mixing preceding said step of filtering.

4. The process of claim 1, said step of mixing following said step of filtering.

5. The process of claim 1, wherein during said filtering a filter aid is added to the heated pitches, and the filter is a metal filter having filter openings of 80–120 microns, and wherein the pitches are pressed through the filter at a differential pressure within the range of 1 to 8 bar.

6. The process of claim 1, said step of mixing being performed by adding the pitches in such proportions that the mixture has a viscosity within the range of 50–200 centipoise at 250°–260° C.

7. The process of claim 1, said step of heating and filtering being performed at an elevated temperature within the range of 100°–200° C. above the softening point of the mixture of pitches.

8. The process of claim 1, wherein said other pitch has a softening point within the range of 120°–180° C., and said step of filtering further comprises adding about 0.5% by weight of a filter aid to the pitches and filtering the pitches until the solid impurities constitute only about 0.1 to 0.3% by weight of the filtrate.

9. The process of claim 1 wherein the amounts of the different pitches are selected so as to form a coke, after mixing and filtering, having a thermal volume expansion of $1.5-1.9\times10^{-6}$/°K., measured at 1300° C.

* * * * *